264-143 SR
2/11/86 OR 4,569,811

United States Patent [19]
Geier

[11] Patent Number: 4,569,811
[45] Date of Patent: Feb. 11, 1986

[54] METHOD OF MAKING A STAPLE-FIBER BAND

[75] Inventor: Rudolf Geier, Essen, Fed. Rep. of Germany

[73] Assignee: Didier Engineering GmbH, Essen, Fed. Rep. of Germany

[21] Appl. No.: 426,063

[22] Filed: Sep. 28, 1982

[30] Foreign Application Priority Data

Oct. 17, 1981 [DE] Fed. Rep. of Germany ..... 3141291

[51] Int. Cl.[4] ..... D01D 9/10
[52] U.S. Cl. ..... 264/143; 19/0.35; 19/0.46; 19/0.56; 264/210.2; 264/210.8
[58] Field of Search ..... 264/143, 210.2, 210.8; 19/.35, .37, .39, .41, .46, .56, .58

[56] References Cited

U.S. PATENT DOCUMENTS

| | | | |
|---|---|---|---|
| 2,733,122 | 1/1956 | Herele et al. | 264/143 |
| 2,748,426 | 6/1956 | Wyatt | 19/.37 |
| 2,784,458 | 3/1957 | Preston | 19/.37 |
| 3,945,188 | 3/1976 | Muller | 19/.35 |
| 4,069,566 | 1/1978 | Sumitomo et al. | 264/168 |
| 4,192,041 | 3/1980 | Sasaki | 19/.35 |
| 4,247,270 | 1/1981 | Schubert | 264/210.8 |
| 4,296,535 | 10/1981 | Li et al. | 28/257 |
| 4,362,682 | 12/1982 | Berg et al. | 264/210.8 |

*Primary Examiner*—Jay H. Woo
*Assistant Examiner*—J. Fortenberry
*Attorney, Agent, or Firm*—Karl F. Ross; Herbert Dubno

[57] ABSTRACT

A staple-fiber band is made by first spinning synthetic-resin filaments with spinnerets and drawing the filaments as roving at a predetermined feed speed from the spinnerets. The roving is then cooled without greatly stretching it so it has relatively high residual stretch and is then stored. Without intermediate treatment the roving is heated to a predetermined temperature and then stretched it to a relatively small residual stretch. The stretched roving is then thermofixed and then stretch-torn. Finally it is textured. During the heating, thermofixing, stretch-tearing, and texturing steps the roving is held under tension so that its filaments cannot tangle. When the filaments are of polyester they are stretched at between 60° C. and 120° C. and thermofixed at a temperature that can be somewhat higher.

9 Claims, 2 Drawing Figures

METHOD OF MAKING A STAPLE-FIBER BAND

FIELD OF THE INVENTION

The present invention relates to a method of and system or apparatus for making a staple-fiber band or a so-called spin band. More particularly this invention concerns such a method and apparatus for producing such a band from melt-spun polyester filaments.

BACKGROUND OF THE INVENTION

A spin or staple-fiber band is basically a thick yarn made of a multiplicity of long staples. When made from polyester the staple must be textured so that the normally smooth and straight monofilaments hold together, giving the staple-fiber band an excellent band.

Such a band is made by first pulling synthetic-resin filaments, typically of polyester, from their spinnerets and cooling them to form filament bundles, hereinafter referred to as rovings, which are set aside or stored. The rovings, are wound up with limited stretching or preorienting because winding-type takeups can typically only operate as a peripheral or filament-feed speed of at most 2000 m/min (about 75 miles/hour), which speed generally corresponds to the speed at which the filaments exit from the orifices of the spinneret. As is known the stretching and the resultant preorienting of the individual filaments depends from the double breaking which in turn is a function of the overfeed or difference between the spinning speed and the takeup speed. Double breaking is the difference of the breaking index in the longitudinal and transverse directions of the filaments.

As a rule the stored rovings are plied to so-called spin cables and are subsequently fully oriented, that is they are stretched to have a residual stretch of between 18% and 30% so they can only be stretched to this extent before the filaments will break. This necessitates an intermediate treatment of the spin cable in a stretching and texturing machine. During such intermediate treatment the spin cable traverses several stretchers with intermediate heaters, then a washing and drying stage, and finally passes through a texturing device followed by a thermofixing unit. The thus fully oriented and almost stretched-out spin cable is then set aside in boxes.

Subsequently the cables are delivered to a tear converter which longitudinally stretch-tears and then textures the spin cable to so-called spinning bands or staple-fiber bands. The stretch and crimping stages preceding the tear converter serve mainly to prevent the filaments from tangling during layup or storage. If the filaments do not remain perfectly parallel in the spin cable it becomes impossible to tear them into perfect spin bands or staple-fiber bands.

Obviously this production technique is fairly complex and quite expensive. Hence it is known to make textured polyester yarn by the set-texturing method with false twist. In this arrangement a roving of filaments of low crystalinity is made by pulling the polyester filaments from the spinnerets with a takeup speed of at least 2750 m/min and is thereafter set-textured to an extent between 1:1.3 and 1:2. The filaments are then thermofixed at above 200° C. so that filament breakage is largely avoided. This procedure does not appreciably affect the production of spinning bands from polyester filaments.

OBJECTS OF THE INVENTION

It is therefore an object of the present invention to provide an improved method of and system for making a polyester staple yarn or band.

Another object is the provision of such a method of and system which overcome the above-given disadvantages.

Yet another object is to simplify the method and system while still producing a high-quality product.

SUMMARY OF THE INVENTION

These objects are attained according to the instant invention in a method of the above-described general type, but wherein the roving that is laid up with its high residual stretch or stretch is worked by the tear converter without any intermediate treatment, by which is meant without an intermediate stretching, texturing, and thermofixing in a separate production stage. In the tear converter the roving is heated to a predetermined temperature, stretched to the predetermined stretch, then thermofixed, and finally torn. Only afterward is the roving textured so as to obtain an internal bond between the staple of the thus produced staple yarn. In fact several rovings can be combined to a so-called spin cable and several such cables can be combined to a spin band, all forming a staple yarn at the end of the process of this invention. The term roving is intended to cover all these workpiece types.

A considerable saving in production and equipment costs is achieved by eliminating the intermediate treatment before working the roving in the tear converter. According to this invention the stretching and resultant full orientation of the filaments of the roving being treated take place right in the tear converter, as part of a continuous stretching and tearing process including prestretching and thermofixing stages. There is no problem with tangling since according to this invention the filaments are held taut, that is under tension, and parallel right up to the downstream tearing zone of the converter. Thus the filaments have no opportunity to tangle subsequent to their prestretching and thermofixing. The roving with its high stretch is first heated in the converter to a predetermined temperature so as to orient the macromolecules or crystalline structure of the filaments longitudinally as they are stretched. The result is longitudinally oriented macromolecules so that intermolecular forces are effective to give the filaments good mechanical characteristics. Full orientation of the roving takes place in the converter immediately upstream of the tear zone.

According to this invention the roving is pulled from the spinnerets with the speed of between 2000 m/min and 5000 m/min and laid up in coils. As a result of this very high takeup speed it is possible to preorient the filaments of the roving somewhat before it enters the converter. As a result it is possible to impart to the roving a residual orientation of between 70% and 350% before it is worked in the converter, the extent of residual orientation being inversely proportional to the takeup speed. In other words the faster the roving is pulled from the spinners, the smaller its residual orientation, and the smaller the work needed to be performed in the converter to achieve full orientation, thereby reducing the size and complexity of this piece of equipment. Due to inertia problems it is impossible to achieve such high takeup speeds with a winding-type takeup mechanism.

To assist the necessary residual orientation so as to obtain full orientation and the desired stretch, the roving is heated after entry into the converter to betweeen 60° C. and 120° C. and thereafter stretched and thermofixed at a temperature of between 60° C. and 140° C. The roving is stretched to a residual stretch of between 15% and 45%, preferably between 18% and 30% in the stretching and thermofixing stages. Depending on the takeup speed the roving is stretched by between 8 and 15 times in the stretching-tearing process of this invention. To facilitate the stretching process the unstretched roving is imparted a filament/metal coefficient of friction equal to less than 0.3, preferably between 0.12 and 0.24.

The converter according to this invention has at least two upstream feeders followed by tearing and texturing zones. In addition between the two differential feeders there is a heater for the taut roving and the downstream feeder of the pair forms with another feeder a stretch zone which itself is provided with a heater for thermofixing the stretched roving. In this manner a modified tear or stretch/tear converter is created which is compact and simple, and which eliminates the need of any intermediate treatment equipment.

The advantages of the system of this invention are that the method and system are particularly simple and efficient. They efficiently produce spin bands or so-called staple-yarn bands from melt-spun synthetic-resin filaments, in particular of polyester. The finished product can be made much more cheaply than by any of the prior-art methods.

DESCRIPTION OF THE DRAWING

The above and other features and advantages will become more readily apparent from the following, reference being made to the accompanying drawings in which.

SPECIFIC DESCRIPTION

Figure 1:
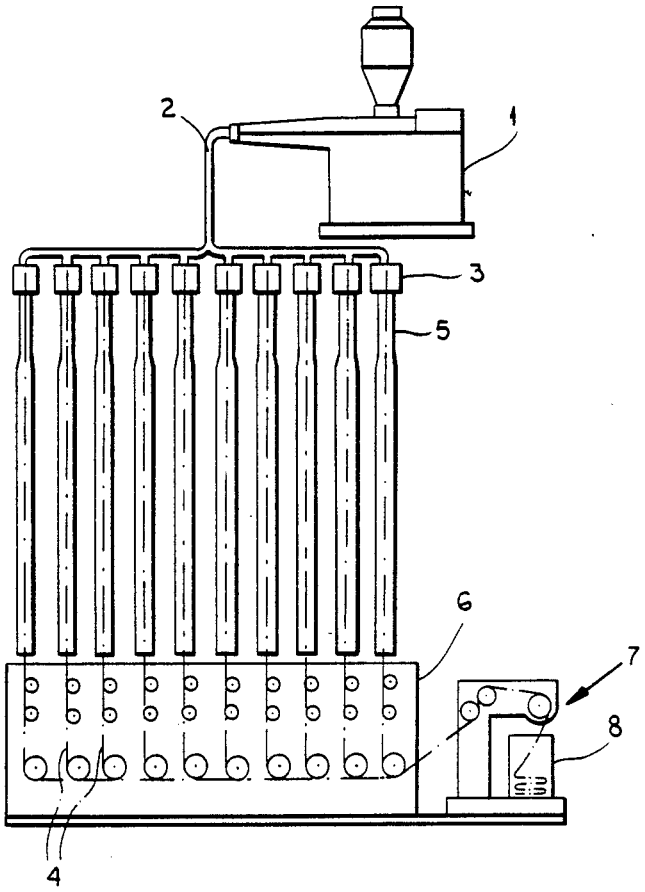
FIG. 1 is a partly schematic side view of the equipment for spinning polyester roving according to the invention.

As seen in FIG. 1, an extruder 1 melts a polyester polymer and feeds the melt via a conduit 2 to individual spinnerets 3 which produce filament bundles or rovings 4. These rovings 4 are transported down cooling tubes 5 and coverter into a single large roving or cable at a spinning machine 6. A coiler 7 deposits the roving 4 in cans 8 in a manner well known.

Figure 2:
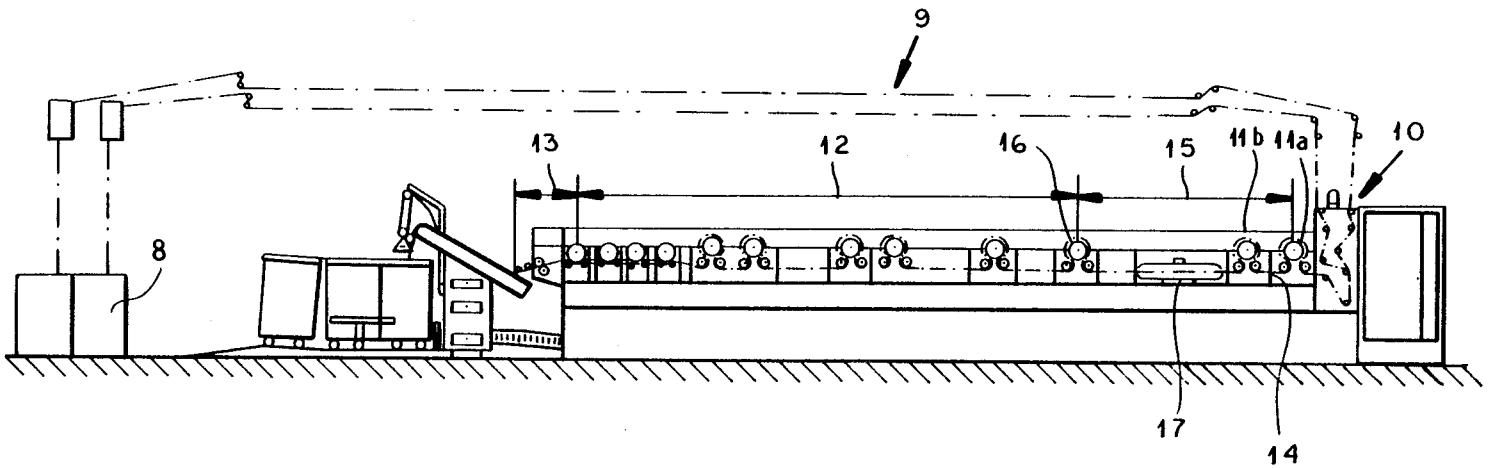
FIG. 2 is a partly schematic side view of the stretch-tearing equipment for the roving according to this invention.

FIG. 2 shows how the rovings 4 are pulled from the cans 8 at a stretch-tear machine or converter 9 having an input 10 provided with a pair of feeders 11*a* and 11*b* flanking a heater 14. The machine has two stretch zones 12 and 15 as well as a crimper or texturer 13. Another feeder 16 is provided between the zones 12 and 15 so any overfeed in these two zones can be different. For thermofixing the zone 15 is provided with a heater tunnel 17 through which the stretched roving 4 extends. Of course instead of the filament bundle or roving 4 the system could work with a spin cable formed of several rovings 4 or a stretch cable formed of several spin cables.

The feeders 11*a* and 11*b* are differentially driven, that is with overfeed, to prestretch the roving 4. The heater 14 aids the stretching so that the desired residual stretch is obtained in the subsequent stretch zone 15. The filaments of the roving 4 are heated between the feeders 11*a* and 11*b* to between 60° C. and 120° C. The subsequent stretching and thermofixing of the roving 4 in the zone 15 takes place in the same temperature range. In the zone 12 the filaments are heated to between 60° C. and 140° C. In this manner full orientation, that is minimal stretch is set in the filaments of the workpiece strand 4.

This process takes place as is known with uncrimped filaments. Crimping is done afterward to create the desired hand.

EXAMPLE

The bundle 4 is formed of polyester filaments of the following characteristics:

Titer: 9.3 den
Strength: 1.36 g/den
Residual stretch: 323%.

The stretch conversion is effected as follows:

Overall starting size: 79.3 g/m
Stretch at 15: 1:2.9
Temperature: 90° C.
Stretch at 12: 1:3.2
Overall ending size: 8.6 g/m.

I claim:

1. A method of making a staple-fiber band, the method comprising the steps of sequentially:

spinning polyester filaments with spinnerets and drawing the polyester filaments as roving at a predetermined feed speed from the spinnerets;

cooling the roving without greatly stretching it so it has relatively high residual stretchability;

imparting to the roving of relatively high stretchability a filament/metal coefficient of friction of less than 0.3;

storing the cooled and substantially unstretched roving;

without intermediate treatment heating the roving to a predetermined temperature and then stretching it to a relatively small residual stretchability;

thermofixing the stretched roving;

stretch-tearing the thermofixed and stretched roving; and texturing the roving.

2. The method defined in claim 1, further comprising the step of maintaining the roving under tension during the heating, thermofixing, stretch-tearing, and texturing steps.

3. The method defined in claim 2 wherein the predetermined feed speed is between 2000 m/min and 5000 m/min.

4. The method defined in claim 2 wherein the relatively high stretch is between 70%. and 350%.

5. The method defined in claim 2 wherein the predetermined temperature is between 60° C. and 120° C., the roving being thermofixed at between 60° C. and 140° C.

6. The method defined in claim 2 wherein the relatively low stretch is between 15% and 45%.

7. The method defined in claim 2 wherein the roving is stretched by a factor of between 8 and 15 between the initial stretching step and the texturing step.

8. The method defined in claim 1 wherein the coefficient lies between 0.12 and 0.24.

9. A method of making a staple-fiber band from hot-spun polyester filaments which are drawn as a roving at a predetermined feed speed from their spinnerets, are cooled, and stored with substantial residual stretch, the stored roving with substantial residual stretch being supplied without intermediate treatment to a converter and there heated to a predetermined temperature, stretched to a predetermined residual stretch, thermofixed, and then stretch-torn, characterized in that the roving with substantial residual stretch is given a filament/metal coefficient of friction of less than 0.3, preferably between 0.1 and 0.24.

* * * * *